US010876377B2

(12) United States Patent
Quero et al.

(10) Patent No.: US 10,876,377 B2
(45) Date of Patent: Dec. 29, 2020

(54) MULTI-LATERAL ENTRY TOOL WITH INDEPENDENT CONTROL OF FUNCTIONS

(71) Applicant: HALLIBURTON ENERGY SERVICES, INC., Houston, TX (US)

(72) Inventors: Philippe Quero, Houston, TX (US); Eric Bivens, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 34 days.

(21) Appl. No.: 16/341,870

(22) PCT Filed: Jun. 29, 2018

(86) PCT No.: PCT/US2018/040456
§ 371 (c)(1),
(2) Date: Apr. 12, 2019

(87) PCT Pub. No.: WO2020/005297
PCT Pub. Date: Jan. 2, 2020

(65) Prior Publication Data

US 2020/0003026 A1 Jan. 2, 2020

(51) Int. Cl.

| | |
|---|---|
| ***E21B 7/08*** | (2006.01) |
| ***E21B 17/20*** | (2006.01) |
| ***E21B 29/06*** | (2006.01) |
| ***E21B 41/00*** | (2006.01) |
| ***E21B 47/022*** | (2012.01) |

(52) U.S. Cl.
CPC ..... *E21B 41/0035* (2013.01); *E21B 47/022* (2013.01); *E21B 41/0078* (2013.01)

(58) Field of Classification Search
CPC . E21B 7/04; E21B 7/067; E21B 17/20; E21B 41/0035; E21B 29/06; E21B 7/08
See application file for complete search history.

(56) References Cited

U.S. PATENT DOCUMENTS 3,799,259 A 3/1974 Dinning
3,965,979 A 6/1976 Lamb
(Continued)

FOREIGN PATENT DOCUMENTS

EP 0562148 A1 9/1993
WO WO-2005019598 A1 3/2005

OTHER PUBLICATIONS

Korean Intellectual Property Office, International Search Report and Written Opinion, PCT/US2018/040456, dated Feb. 21, 2019, 16 pages, Korea.

*Primary Examiner* — Kenneth L Thompson
(74) *Attorney, Agent, or Firm* — Haynes and Boone, LLP

(57) ABSTRACT

A multilateral entry tool enables an operator to identify a target lateral wellbore, and efficiently guide a bottom hole assembly (BHA) into the target lateral for diagnostic, servicing or other wellbore operations. The multilateral entry tool provides independent control over both kick-over and orientation mechanisms such that the operator may either pivot the BHA without rotating, or rotate the BHA without pivoting. The BHA may be rotated in either direction, and the degree that the BHA can be pivoted may be fully adjustable. Sensors on the entry tool may penult the operator to verify a successful lateral entry, and the BHA may be straightened to reduce drag as the BHA is advanced into the lateral wellbore.

18 Claims, 5 Drawing Sheets

(56) References Cited

U.S. PATENT DOCUMENTS

| | | | | |
|---|---|---|---|---|
| 4,002,203 | A | 1/1977 | Terral | |
| 4,294,313 | A | 10/1981 | Schwegman | |
| 4,440,222 | A | 4/1984 | Pullin | |
| 4,524,833 | A | 6/1985 | Hilts et al. | |
| 4,574,883 | A | 3/1986 | Carroll et al. | |
| 4,624,309 | A | 11/1986 | Schnatzmeyer | |
| 4,744,415 | A | 5/1988 | Crawford et al. | |
| 4,757,859 | A | 7/1988 | Schnatzmeyer | |
| 4,765,403 | A | 8/1988 | Crawford | |
| 4,825,946 | A | 5/1989 | Schnatzmeyer | |
| 7,188,685 | B2 * | 3/2007 | Downton | E21B 7/067 175/104 |
| 7,886,835 | B2 | 2/2011 | Arumugam et al. | |
| 7,967,075 | B2 | 6/2011 | Arumugam et al. | |
| 8,800,652 | B2 | 8/2014 | Bartko et al. | |
| 9,140,102 | B2 | 9/2015 | Bartko et al. | |
| 9,206,649 | B1 * | 12/2015 | Zupanick | E21B 3/00 |
| 9,366,087 | B2 * | 6/2016 | Sugiura | E21B 7/067 |
| 9,464,482 | B1 | 10/2016 | Bargach et al. | |
| 9,663,993 | B2 * | 5/2017 | Gajji | E21B 7/067 |
| 10,378,283 | B2 * | 8/2019 | Peters | E21B 17/05 |
| 10,415,316 | B2 * | 9/2019 | Van Og | E21B 7/068 |
| 10,626,675 | B2 * | 4/2020 | Ross | E21B 7/062 |
| 2007/0267200 | A1 | 11/2007 | Jackson et al. | |
| 2008/0135296 | A1 | 6/2008 | Tashiro et al. | |
| 2011/0162890 | A1 | 7/2011 | Radovan | |
| 2012/0234604 | A1 | 9/2012 | Hall et al. | |
| 2017/0260834 | A1 | 9/2017 | Chacon et al. | |

* cited by examiner

MULTI-LATERAL ENTRY TOOL WITH INDEPENDENT CONTROL OF FUNCTIONS

CROSS-REFERENCE TO RELATED APPLICATIONS

This application is a U.S. national stage patent application of International Patent Application No. PCT/US2018/040456, filed on Jun. 29, 2018, the benefit of which is claimed and the disclosure of which is incorporated herein by reference in its entirety.

BACKGROUND

The present disclosure relates generally to subterranean tools and methods for accessing lateral wellbores. More particularly, embodiments of the disclosure include an orientation mechanism for selecting a tool face of the subterranean tools and a kick-over mechanism for articulating a body of the subterranean tools.

Operators seeking to produce hydrocarbons from subterranean formations often drill multilateral wells. Unlike conventional vertical wells, a multilateral well includes a primary wellbore and one or more lateral wellbores that branch from the primary wellbore. Although multilateral wells are often more expensive to drill and complete than conventional wells, multilateral wells are generally more cost-effective overall, as they usually maximize production of reservoirs and therefore have greater production capacity and higher recoverable reserves. Multilateral wells are also an attractive choice in situations where it is necessary or desirable to reduce the amount of surface drilling operations, such as when environmental regulations impose drilling restrictions. Although multilateral wells may offer advantages over conventional wells, they may also involve greater complexity, which may pose additional challenges. One such challenge involves locating and entering a specific lateral wellbore that branches from a primary wellbore.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes a multilateral entry tool that enables an operator to identify a target lateral wellbore, and efficiently guide a bottom hole assembly (BHA) into the target lateral for diagnostic, servicing or other wellbore operations. The entry tool provides independent control over both kick-over and orientation mechanisms such that an operator may either pivot the BHA without rotating, or rotate the BHA without pivoting. The BHA may be rotated in either direction, and the degree that the BHA can be pivoted may be fully adjustable. Sensors on the entry tool may detect downhole parameters that can be transmitted uphole via cable, mechanical, wireless, or other telemetry methods to thereby permit the operator to verify a successful lateral entry. The BHA may then be straightened to reduce drag as the BHA is advanced into the lateral wellbore.

Figure 1:
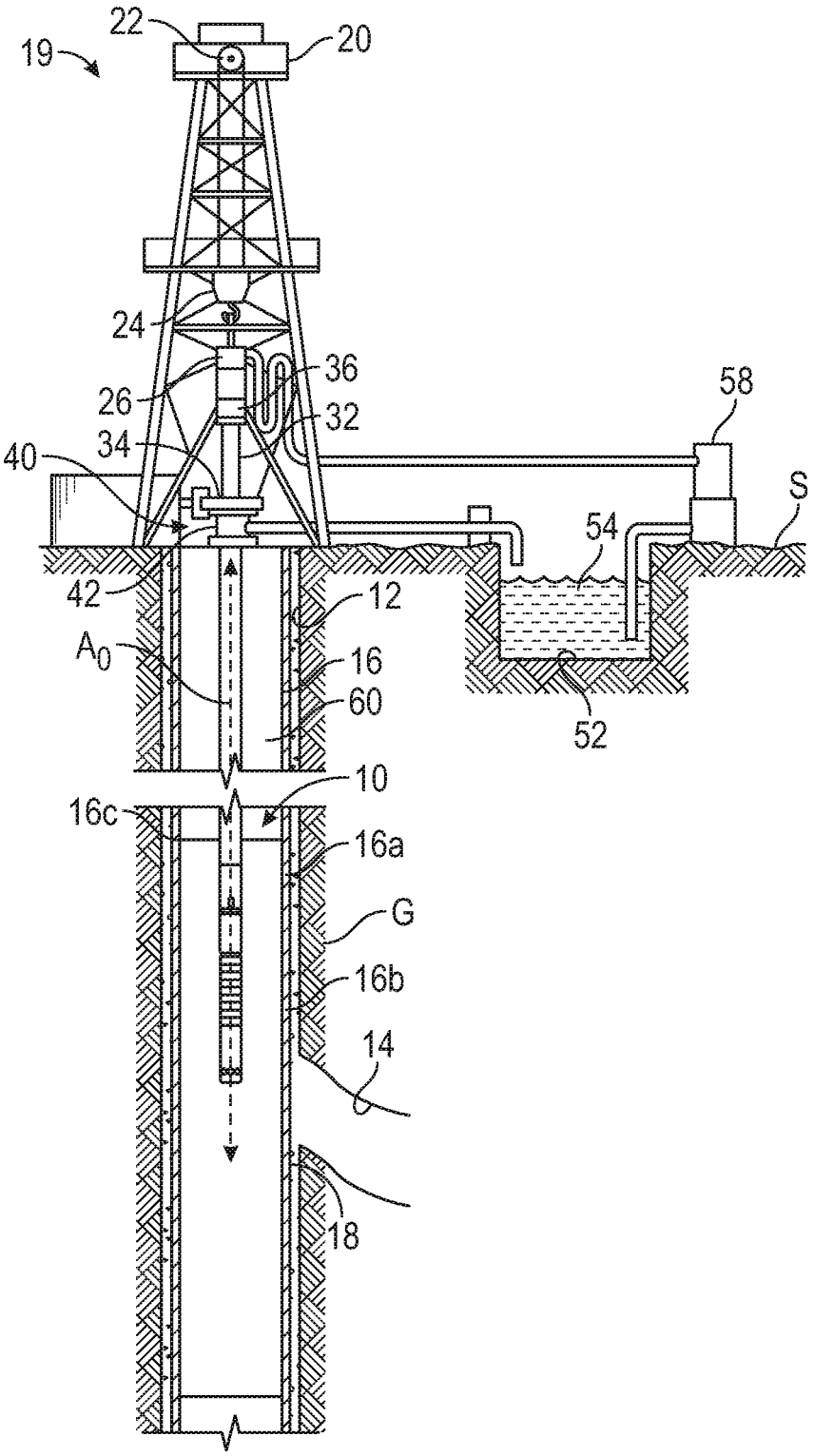
FIG. 1 is a partial cross-sectional side view a multilateral entry tool deployed within a wellbore on a jointed conveyance in accordance with embodiments of the present disclosure.

An example embodiment of a multilateral entry tool 10 in a main wellbore 12 is illustrated in FIG. 1. The main wellbore 12 extends through into a geologic formation "G" from a terrestrial or land-based surface location "S." In other embodiments, a wellbore may extend from offshore or subsea surface locations (not shown) using with appropriate equipment such as offshore platforms, drill ships, semi-submersibles and drilling barges. The main wellbore 12 defines an "uphole" direction referring to a portion of main wellbore 12 that is closer to the surface location "S" and a "downhole" direction referring to a portion of main wellbore 12 that is further from the surface location "S."

Main wellbore 12 is illustrated in a generally vertical orientation extending along an axis $A_0$. In other embodiments, the main wellbore 12 may include portions in alternate deviated orientations such as horizontal, slanted or curved without departing from the scope of the present disclosure. Branching from main wellbore 12 is a lateral wellbore 14 extending at an oblique angle from the main wellbore 12. Although only one lateral wellbore is illustrated, any number of lateral wellbores 14 may extend from the main wellbore 12 at distinct depths and orientations. Main wellbore 12 optionally includes a casing string 16 therein, which extends generally from the surface location "S" to a selected downhole depth. Casing string 16 may be constructed of distinct casing sections 16*a*, 16*b* coupled to one another at a casing collar 16*c*. Portions of the main wellbore 12 that do not include casing string 16 may be described as "open hole." A window 18 is defined in the casing string 16 at the location of lateral wellbore 14 to permit access to the lateral wellbore 14 from the main wellbore 12. Lateral wellbore 14 is illustrated in an "open hole" configuration, and in other embodiments, portions of the lateral wellbore 14 may be cased.

Main wellbore 12 is part of a wellbore system 19 including a derrick or rig 20. Rig 20 may include a hoisting apparatus 22, a travel block 24, and a swivel 26 for raising and lowering a conveyance such as tubing string 30. Other types of conveyance include tubulars such as drill pipe, a work string, coiled tubing (see, e.g., FIG. 5), production tubing (including production liner and production casing), and/or other types of pipe or tubing strings collectively referred to herein as tubing string 30. Still other types of conveyances include wirelines, slicklines or cables, which may be used, e.g., in embodiments where fluid flow thought a BHA is not required. Tubing string 30 may be constructed of a plurality of pipe joints coupled together end-to-end, or as a continuous tubing string, supporting the multilateral entry tool 10 as described below. Rig 20 may include a kelly 32, a rotary table 34, and other equipment associated with rotation and/or translation of tubing string 30 within a main wellbore 12. For some applications, rig 20 may also include a top drive unit 36. Rig 20 may also be replaced entirely with coiled tubing (see FIG. 5) or capillary tubing unit.

Rig 20 may be located proximate to a wellhead 40 as shown in FIG. 1, or spaced apart from a wellhead 40, in the case of an offshore arrangement (not shown). One or more pressure control devices 42, such as blowout preventers (BOPS) and other equipment associated with drilling or producing a wellbore may also be provided at wellhead 40 or elsewhere in the wellbore system 10.

A fluid source 52, such as a storage tank or vessel, may supply a working or service fluid 54 pumped to the upper end of tubing string 30 and flow through tubing string 30. Fluid source 52 may supply any fluid utilized in wellbore operations, including without limitation, drilling fluid, cementitious slurry, acidizing fluid, liquid water, steam, hydraulic fracturing fluid, propane, nitrogen, carbon dioxide, cleanout fluid or some other type of fluid. Fluid 54 may be pumped to the multilateral entry tool 10 through the tubing string 30 by a pump 58. The fluid may be discharged from the multilateral entry tool 10 within the main wellbore 12, and returned to the surface location "S" through an annulus 60 defined between the tubing string 30 and the casing string 16. The fluid 54 may then be returned to the fluid source 52 for recirculation through the wellbore system 19.

Figure 2C:
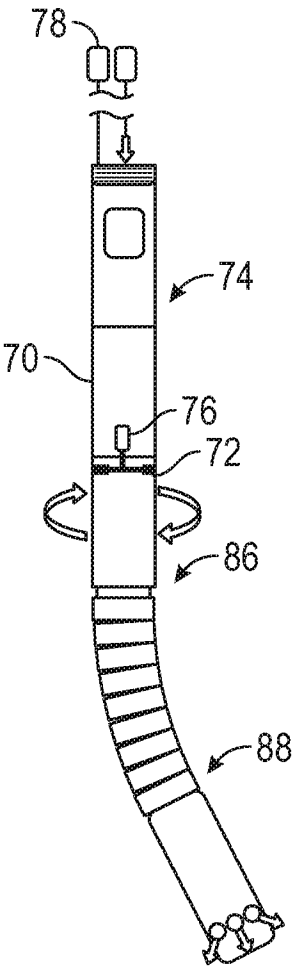
FIG. 2C is a schematic view of the multilateral entry tool of FIG. 2B in an oriented configuration induced by operating an orientation actuator.
Figure 2B:
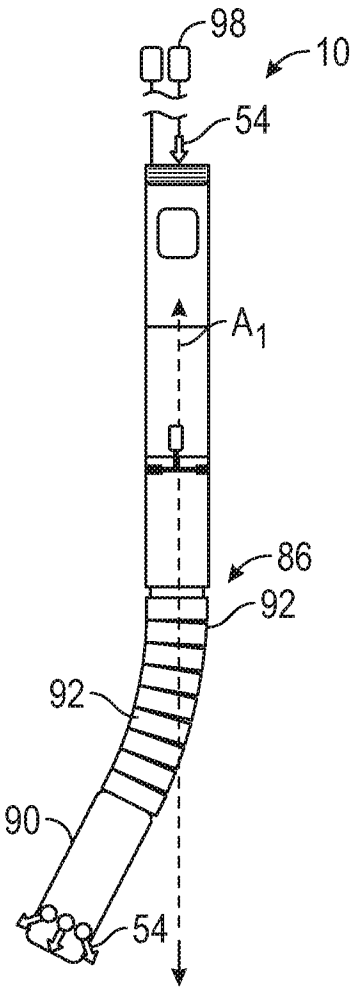
FIG. 2B is a schematic view of the multilateral entry tool of FIG. 2A in an articulated configuration induced by operating a kick-over actuator.
Figure 2A:
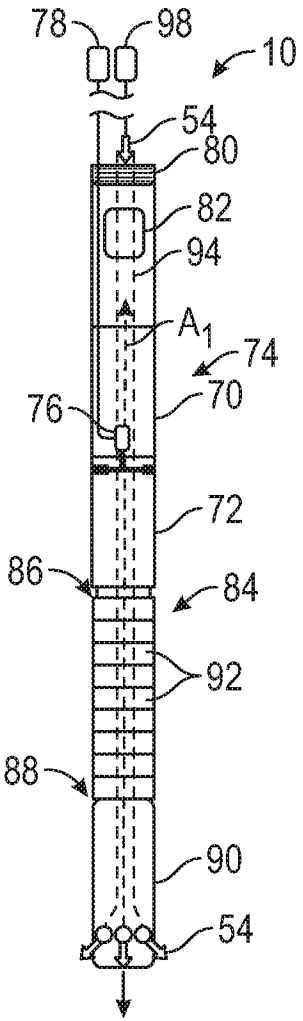
FIG. 2A is a schematic view of the multilateral entry tool of FIG. 1 in a straight configuration, illustrating two independent actuators for operating a kick-over mechanism and an orientation mechanism of the multilateral entry tool.

FIG. 2A is a schematic view of the multilateral entry tool 10 in a straight configuration. The multilateral entry tool 10 includes an upper housing 70 and a lower housing 72, coupled to one another along a tool axis $A_1$. The upper and lower housings 70, 72 are rotationally coupled to one another to permit rotational movement therebetween about the tool axis $A_1$, and together define an orientation sub 74. A rotational driver 76, such as an electric motor, is disposed within the upper housing 70 of the orientation sub, and is operable to selectively induce rotational motion of the lower housing 72 with respect to the upper housing 70 in either direction, e.g., clockwise and counter-clockwise directions. Other rotational drivers 76 may include hydraulic, pneumatic, mechanical or other mechanisms recognized in the art. A first actuator, controller or orientation actuator 78 is operably coupled to the rotational driver 76 to permit an operator to selectively operate the rotational driver 76. The first actuator 78 may be disposed at the surface location "S" (FIG. 1) or at a downhole location. The upper housing 70 defines a connector 80 such as threads, latches, etc., for coupling the multilateral entry tool 10 to the lower end of tubing string 30 (FIG. 1). The connector 80 may fixedly couple the upper housing to the tubing string 30, and thus, in some embodiments, the rotational driver 76 may selectively rotate the lower housing 72 with respect to the tubing string 30.

The upper housing 70 may also support a sensor package 82 therein. For tool strings 30 equipped with real-time communication capabilities, the sensor package 82 provides an operator with real-time information regarding position and configuration of the multilateral entry tool 10. For example, the sensor package 82 may include tool face sensors, inclination sensors, gamma sensors, casing collar locators (CCL) or cameras, which can provide additional verification of a successful entry into a lateral wellbore as described below. In some embodiments, the sensor package 82 is disposed in a separate sensor sub coupled to the upper housing 70.

A kick-over sub 84 is coupled to a lower end of the lower housing 74. In the embodiment illustrated in FIG. 2A, the kick-over sub 84 includes a segmented tubular section 86 and a bottom hole assembly BHA 88 including a fluid nozzle 90. The segmented tubular section 86 includes a plurality of pivotally coupled sections 92, which permits the multi lateral entry tool 10 to be moved to an articulated position wherein BHA 88 is obliquely arranged with respect to the tool axis $A_1$ (see FIG. 2B). Sections 92 may simply added or removed from a segmented tubular section 86 as the kick-over sub 84 is manufactured to adjust the angle of the bend to suit different well geometries or BHA 88 lengths. In other embodiments (not shown) the BHA 88 may include any tool or structure useful in completing or servicing the lateral wellbore 14 or vertical main wellbore 12. Also, in other embodiments, the kick-over sub 84 may include any structure operable to move the BHA 88 between aligned and oblique arrangements with respect to the tool axis $A_1$ (see FIG. 2B). For example, the kick-over sub may include an indexed, knuckle-type kick-over sub operable to move the BHA 88 discrete articulated and incremental rotational positions by cycling a fluid pressure within multilateral entry tool 10.

A fluid passageway 94 extends through the multilateral entry tool 10 fluidly coupling the nozzle 90 to the tubular string 30 (FIG. 1). The multilateral entry tool 10 may maintain the straight configuration when fluid 54 is passed through the fluid passageway 94 at a rate less than a predetermined threshold. A second actuator or kick-over actuator 98 is operatively coupled to the fluid passageway for controlling a rate of fluid 54 flowing through the fluid passageway 94. In some embodiments, the second actuator 98 may include the pump 58 (FIG. 1) at the surface location "S."

FIG. 2B is a schematic view of the multilateral entry tool 10 in an articulated configuration induced by operating the kick-over actuator 98. For example, the kick-over actuator 98 may have been operated to increase the flow of fluid 54 to a flowrate greater than the predetermined threshold. With the increased flowrate, a pressure differential across the nozzle 90 may be sufficient to move cause the sections 92 to pivot relative to one another, thereby bending the segmented tubular section 86 and moving the nozzle 90 to the oblique orientation with respect to the tool axis $A_1$. The kick-over actuator 98 may be operated without rotating the nozzle 90 with respect to the tool axis $A_1$ or the tubular string 30 and longitudinal axis $A_0$ (FIG. 1).

FIG. 2C is a schematic view of the multilateral entry tool of FIG. 2B in an oriented configuration induced by operating the orientation actuator 78. The orientation actuator 78 may be operated to send a control signal to the rotational driver 76 to thereby rotate the lower housing 72 with respect to the upper housing 70 of the orientation sub 74. Since the segmented tubular section 86 and BHA 88 are coupled to the lower housing 72, the BHA 88 is rotated to the illustrated position while the multilateral entry tool 10 maintains the articulated position. In the oriented configuration of FIG. 2C, the BHA 88 is rotated generally up to 180 degrees in either direction (e.g., clockwise or counterclockwise) from an un-oriented configuration of FIG. 2C. In other embodiments, the oriented configuration may require a distinct degree of rotation of the lower housing 72 that is less than 180 degrees to align the BHA with the lateral wellbore 14 in any rotational position.

Although FIGS. 2A, 2B, and 2C illustrate the end of the BHA 88 as equipped with a nozzle tool 90, in other embodiments, a BHA may be provided equipped with alternate subterranean tools without departing from the scope of the disclosures. For example, a BHA may be provided with tools such as milling tools, shifting tools, venturi subs, or any number of other downhole components as needed to complete various operational objectives.

FIGS. 3A through 3E are sequential views of the multilateral entry tool 10 in various stages of a procedure 100 (illustrated in the flowchart of FIG. 4) for entering the lateral wellbore 14. Initially, the multilateral entry tool 10 is lowered or run into the main wellbore 12 on the tubular string 30 or other conveyance at step 102 (see FIG. 3A). The rig 20 (FIG. 1) may be employed to lower the multilateral entry tool 10 into the main wellbore 12, and as the multilateral entry tool 10 is lowered, the sensor package 82 may operate to count the casing collars 16*c* encountered. As the multilateral entry tool 10 approaches the depth of the lateral wellbore 14 and an expected number of casing collars 16*c* is encountered, the multilateral entry tool 10 may be held at a depth above the lateral wellbore 14. In other embodiments, the sensor package 82 or other portions of the tubular string 30 may include other tools for of depth correlation, such as an in-line camera, gamma sensor, and/or caliper. Other tools such as an in-line camera may provide an indication of depth and tool face to an operator at the surface location "S."

Figure 3E:
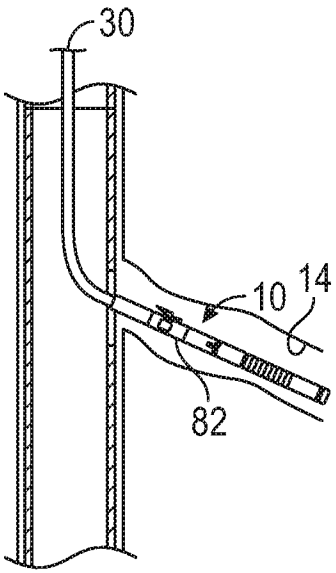
FIGS. 3A through 3E are sequential views of the multilateral entry tool in various stages of a procedure for entering a lateral wellbore.
Figure 3D:
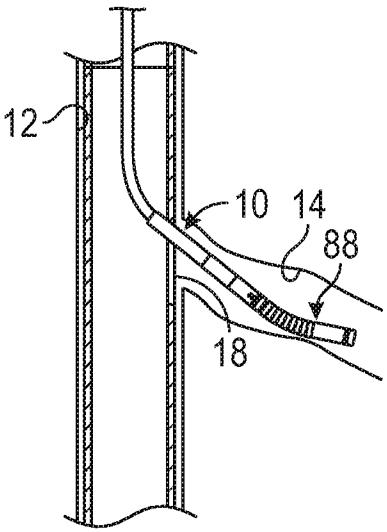
Figure 3C:
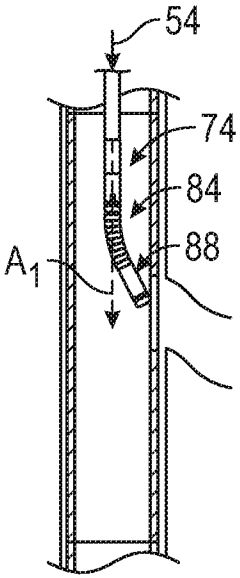
Figure 3B:
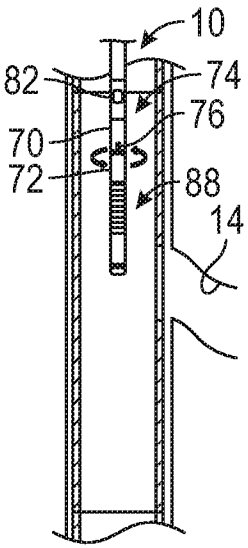
Figure 3A:
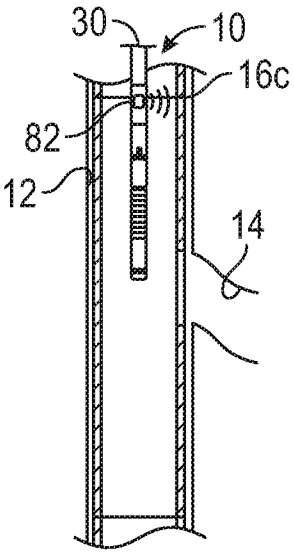

As illustrated in FIG. 3B, at step 104 the multilateral entry tool 10 may be rotationally oriented. The sensor package 82 may provide an initial tool face orientation of BHA 88, and the difference between the initial tool face and the circumferential position of the lateral wellbore 14 is determined. The orientation actuator 78 (FIG. 2C) may be employed to command the rotational driver 76 to rotate the lower housing 72 by the exact difference between the initial tool face and the circumferential position of the lateral wellbore 14. The lower housing 72 may be rotated in a clockwise or counterclockwise direction, whichever is shorter, with respect to the upper housing 70 of the orientation sub 74. The BHA 88 may thereby be rotationally oriented without pivoting the BHA 88.

Next, as illustrated in FIG. 3C, at step 106, the multilateral entry tool is moved to the articulated position to pivot the BHA 88. The kick-over actuator 98 (FIG. 2B) may be employed to increase the flow rate of fluid 54 through the multilateral entry tool 10 above the necessary threshold to bend the kick-over sub 84 (FIG. 2B). In some embodiments, the amount the flow rate is increased above the threshold will correspond to an increased amount the BHA 88 pivots from the tool axis $A_1$. The rotational orientation of the BHA is maintained as the kick-over actuator is activated to pivot the BHA 88 toward the lateral wellbore 14. Since the orientation sub 74 and kick-over sub 84 are independently activated, steps 106 and 104 may be performed in an opposite order if necessary.

Next, as illustrated in FIG. 3D, at step 108, the multilateral entry tool 10 is lowered further in the main wellbore 12 such that the BHA 88 passes through the window 18. If the BHA 88 is properly oriented and pivoted, the multilateral entry tool 10 will enter the lateral wellbore 14 in the articulated configuration.

As illustrated in FIG. 3E, at step 110, an inclination sensor within the sensor package 82 may verify that an expected inclination of the sensor package 82 has been achieved to verify a successful entry into the lateral wellbore 14. Alternatively or additionally, some embodiments may utilize a gamma sensor in the sensor package 82 to verify identify lateral entry based on identifying an expected lithology, for example. The sensor package 82 may communicate a signal indicative of a successful entry to the surface location "S" to an operator. Next, the kick-over actuator 98 (FIG. 2B) may optionally be again actuated to return the multilateral entry tool 10 to the straight configuration illustrated in FIG. 3E (step 112). In the straight configuration, friction between the multilateral entry tool 10 and the lateral wellbore 14 may be reduced as the multilateral entry tool 10 is further advanced (step 114) into the lateral wellbore 14 to carry out a wellbore operation. The multilateral entry tool 10 may be withdrawn from the lateral wellbore 14, and the procedure 100 may be repeated for additional lateral wellbores 14 branching from the main wellbore 12.

Figure 5:
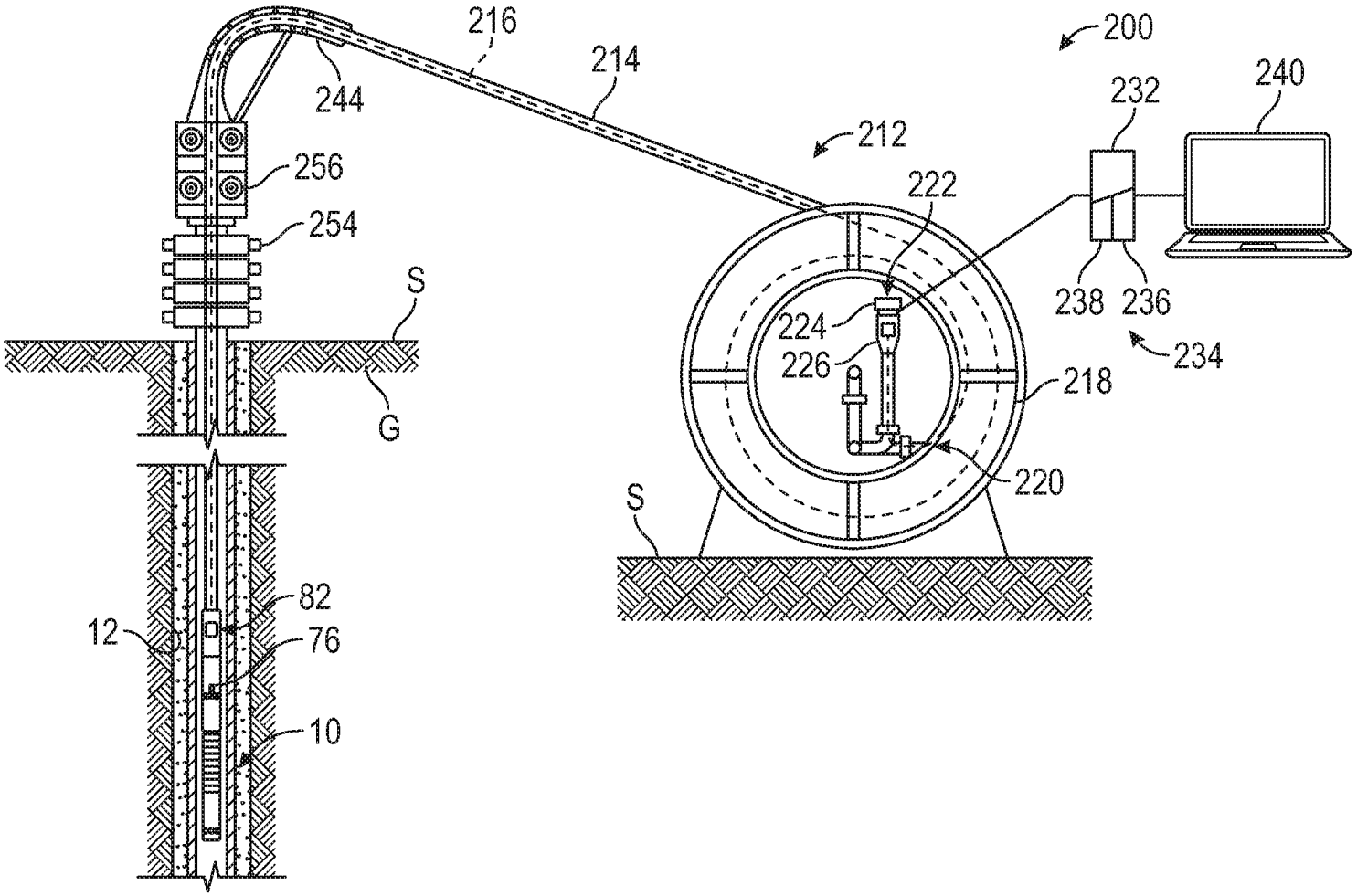
FIG. 5 is a partial cross-sectional side view the multilateral entry tool deployed within a wellbore on a coiled tubing strand in accordance with other embodiments of the present disclosure.

FIG. 5 is a partially cross-sectional side view of a coiled-tubing system 200 employing the multilateral entry tool 10 in accordance with exemplary embodiments of the present disclosure. The coiled-tubing system 200 includes a deployment tool 212, which generally includes a coiled tubing strand or string 214 and a signal cable 216. The signal cable 216 extends along a length of the coiled tubing strand 114 and may facilitate real-time communication of data, instructions and/or electrical power with the multilateral entry tool 10. Camera images, casing collar counts, and other data front sensor package 82, e.g., for locating a lateral wellbore, may be transmitted uphole via the signal cable 216. Instructions for the rotational driver 76 may be transmitted downhole via the signal cable 216 in some embodiments. Although FIG. 5 illustrates signal cable 216 for communicating with the multilateral entry tool 10, in other embodiments, wireless or other telemetry systems may be employed without departing from the scope of the disclosure.

The coiled tubing string 214 and the signal cable 216 are wound together around a spool 218, which facilitates storage, transportation and deployment of the coiled tubing string 214 and signal cable 216. An upper end 220 of the coiled tubing string 214 is coupled to a reel termination assembly 222, which may be configured to permit fluids and solid objects to be pumped through the coiled tubing string 214 to and from the multilateral entry tool 10 as the spool 118 is rotated. The reel termination assembly 222 includes an inlet 224 through which fluids may be pumped into and/or out of the coiled tubing string 214, e.g., to activate the kick-over sub 84 (FIG. 2A). The reel termination assembly 222 also includes a bulkhead device 226 where an additional length of signal cable 216 may be inserted into the coiled tubing string 214, or a length of the signal cable 216 may be withdrawn from the coiled tubing string 214.

Figure 4:
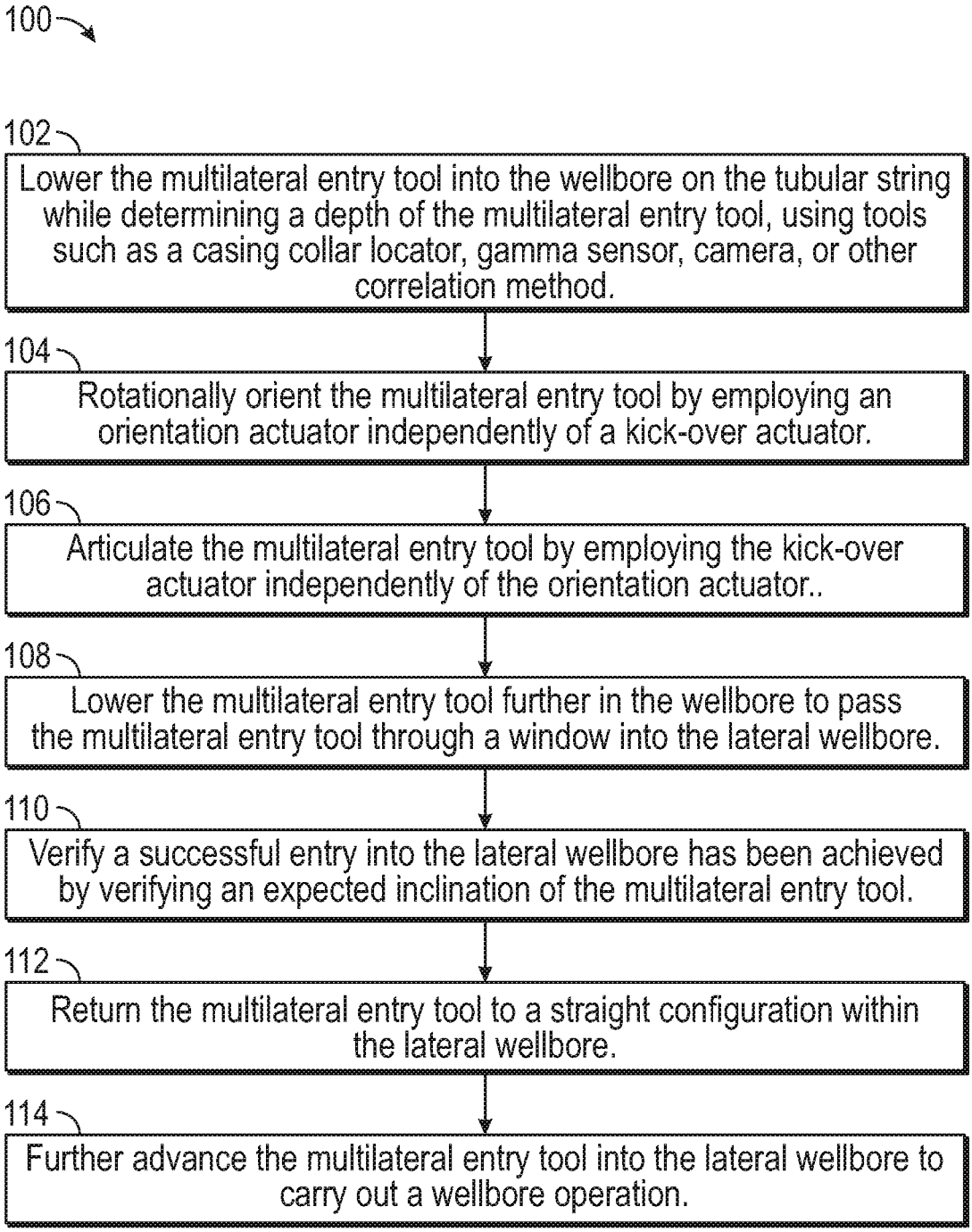
FIG. 4 is a flowchart illustrating the procedure for entering the lateral wellbore of FIGS. 3A through 3E.

In some embodiments, the bulkhead device 226 may facilitate connection of the signal cable 216 to a communication unit 232. The communication unit 232 is operable to supply telemetry signals to the signal cable 216 and receive and/or analyze returned telemetry signals, e.g., from the sensor package 82 in the multilateral entry tool 10. The communication unit 232 is operably coupled to a controller 234 having a processor 236 and a computer readable medium 238 operably coupled thereto. The computer readable medium 238 can include a nonvolatile or non-transitory memory with data and instructions that are accessible to the processor 236 and executable thereby. The computer readable medium 238 may also be pre-programmed or selectively programmable with instructions for implementing any of the steps of procedure 100 (FIG. 4). Alternatively or additionally, the processor 236 may be optionally coupled to a desktop computer 240 having a display, or another computing device which may receive data from the multilateral entry tool. In some embodiments, the desktop computer 240 may receive signals indicative of a successful entry into a lateral wellbore 14 (FIG. 1) detected by communication unit 232 and/or processor 236. The desktop computer 240 may process the signals for display, storage and/or further processing.

From the spool 218, the coiled tubing string 214 extends over guide arch 244 into main wellbore 12. A blowout preventer stack 254 is provided at the surface location "S," and may be automatically operable to seal the wellbore 12 in the event of an uncontrolled release of fluids from the wellbore 12. Also at the surface location "S," a tubing injector 256 is provided to selectively impart drive forces to the coiled tubing string 214, e.g., to run the string 214 into the wellbore 12 or to pull the string 214 from the wellbore 12. The tubing injector 256, guide arch 244 and other equipment may be supported on a derrick (not shown), crane or similar other oilfield apparatus, as appreciated by those skilled in the art.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a multilateral entry tool for entering a lateral wellbore extending obliquely from a main wellbore. The multilateral entry tool includes a connector for connecting an upper housing of the multilateral entry tool to a wellbore conveyance. An orientation sub includes a rotational driver selectively operable for rotating a lower housing of the multilateral entry tool with respect to the upper housing about a tool axis defined by the multilateral entry tool. A kick-over sub is coupled to the lower housing and is operable to support a bottom hole assembly in an aligned configuration and an oblique pivoted orientation with respect to the tool axis. A pair of actuators are independently operable from one another to respectively rotate the lower housing about the tool axis without pivoting the BHA with respect to the tool axis, and to pivot the BHA with respect to the tool axis without rotating the lower housing about the tool axis.

In one or more exemplary embodiments, the kick-over sub comprises a segmented tubular section having sections operable to pivot with respect to one another in response to a flow rate through a fluid flow path extending through the segmented tubular section reaching a predetermined threshold. In some embodiments, the BHA includes a nozzle assembly fluidly coupled to the fluid flow path to discharge fluid from the multilateral entry tool. In one or more embodiments, the pair of actuators comprises a fluid pump in fluid communication with the fluid flow path and operable to adjust the flow rate through the fluid flow path.

In some embodiments, the rotational driver comprises a motor disposed within at least one of the upper or lower housings. In some embodiments, the multilateral entry further includes a sensor package including a sensor therein operable to determine a depth of the multilateral entry tool within the main wellbore. The sensor package may further include a toolface sensor operable to determine a rotational orientation of the multilateral entry tool and an inclination sensor operable to determine an inclination of the multilateral entry tool.

According to another aspect, the disclosure is directed to a wellbore system for entering a lateral wellbore. The system includes a conveyance extending into a main wellbore and an orientation sub coupled to a lower end of the conveyance. The orientation sub includes an upper housing, a lower housing and a rotational driver selectively operable for rotating the lower housing of the orientation sub with respect to an upper housing about a tool axis defined by the orientation sub. The system also includes a kick-over sub coupled to the lower housing and operable to support a bottom hole assembly (BHA) in an aligned configuration and an oblique, pivoted orientation with respect to the tool axis. A pair of actuators are independently operable from one another to respectively rotate the lower housing about the tool axis without pivoting the BHA with respect to the tool axis, and to pivot the BHA with respect to the tool axis without rotating the lower housing about the tool axis.

In some example embodiments, the wellbore system further includes a fluid source in fluid communication with the kick-over sub through the conveyance. In some embodiments, the kick-over sub includes a segmented tubular section having sections operable to pivot with respect to one another in response to a flow rate through a fluid flow path extending through the segmented tubular section reaching a predetermined threshold. The BHA may include a downhole tool fluidly coupled to the fluid flow path to discharge fluid from BHA into the wellbore. In some embodiments, the pair of actuators comprises a fluid pump in fluid communication with a fluid source and operable to adjust the flow rate of fluid through the fluid flow path.

In one or more embodiments, conveyance includes a coiled tubing strand, and in some embodiments, the conveyance includes a jointed tubular conveyance. In some embodiments, the rotational driver includes a motor disposed within at least one of the upper or lower housings. In some embodiments, the wellbore system further includes a sensor package coupled between the conveyance and the upper housing. The sensor package may include at least one of the group consisting of a camera, a casing collar locator operable to determine a depth of the multilateral entry tool within the main wellbore, a toolface sensor operable to determine a rotational orientation of the BHA and an inclination sensor operable to determine an inclination of the sensor package.

According to another aspect, the disclosure is directed to a method of deploying a bottom hole assembly (BHA) into a lateral wellbore branching from a main wellbore. The method includes (a) conveying the BHA into the main wellbore on a wellbore conveyance to a depth above the lateral wellbore, (b) rotationally orienting the BHA with an orientation sub coupled to the conveyance and defining a tool axis by employing an orientation actuator independently of a kick-over actuator to rotate the BHA about the tool axis without pivoting the BHA with respect to the tool axis, (c) articulating the BHA with a kick-over sub coupled to the orientation sub by employing a kick-over actuator independently of the orientation actuator to pivot the BHA without rotating the BHA, and (d) further conveying, after orienting and articulating the BHA, to pass the BHA through a casing window into the lateral wellbore.

In some example embodiments, the method further includes returning the BHA to an aligned configuration with respect to the orientation sub within the lateral wellbore and further advancing the BHA into the lateral wellbore. In some embodiments, the method further includes counting casing collars in a casing string in the main wellbore to determine a depth of the BHA relative to the lateral wellbore. In one or more example embodiments, the method further comprises verifying an entry into the lateral wellbore by measuring an expected inclination of the lateral wellbore with an inclination sensor coupled between the orientation sub and the conveyance.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A multilateral entry tool for entering a lateral wellbore extending obliquely from a main wellbore, the multilateral entry tool comprising:

a connector for connecting an upper housing of the multilateral entry tool to a wellbore conveyance;

an orientation sub including a rotational driver selectively operable for rotating a lower housing of the multilateral entry tool with respect to the upper housing about a tool axis defined by the multilateral entry tool;

a kick-over sub coupled to the lower housing and operable to support a bottom hole assembly (BHA) in an aligned configuration and an oblique pivoted orientation with respect to the tool axis; and a pair of actuators independently operable from one another to respectively rotate the lower housing about the tool axis without pivoting the BHA with respect to the tool axis, and to pivot the BHA with respect to the tool axis without rotating the lower housing about the tool axis.

2. The multilateral entry tool of claim 1, wherein the kick-over sub comprises a segmented tubular section having sections operable to pivot with respect to one another in response to a flow rate through a fluid flow path extending through the segmented tubular section reaching a predetermined threshold.

3. The multilateral entry tool of claim 2, wherein the BHA includes a nozzle assembly fluidly coupled to the fluid flow path to discharge fluid from the multilateral entry tool.

4. The multilateral entry tool of claim 3, wherein the pair of actuators comprises a fluid pump in fluid communication with the fluid flow path and operable to adjust the flow rate through the fluid flow path.

5. The multilateral entry tool of claim 1, wherein the rotational driver comprises a motor disposed within at least one of the upper or lower housings.

6. The multilateral entry tool of claim 1, further comprising a sensor package including a sensor therein operable to determine a depth of the multilateral entry tool within the main wellbore.

7. The multilateral entry tool of claim 6, wherein the sensor package further includes a toolface sensor operable to determine a rotational orientation of the multilateral entry tool and an inclination sensor operable to determine an inclination of the multilateral entry tool.

8. A wellbore system for entering a lateral wellbore, the system comprising:

a conveyance extending into a main wellbore;

an orientation sub coupled to a lower end of the conveyance, the orientation sub including an upper housing, a lower housing and a rotational driver selectively operable for rotating the lower housing of the orientation sub with respect to an upper housing about a tool axis defined by the orientation sub;

a kick-over sub coupled to the lower housing and operable to support a bottom hole assembly (BHA) in an aligned configuration and an oblique pivoted orientation with respect to the tool axis; and a pair of actuators independently operable from one another to respectively rotate the lower housing about the tool axis without pivoting the BHA with respect to the tool axis, and to pivot the BHA with respect to the tool axis without rotating the lower housing about the tool axis.

9. The wellbore system of claim 8, further comprising a fluid source in fluid communication with the kick-over sub through the conveyance, and wherein the kick-over sub comprises a segmented tubular section having sections operable to pivot with respect to one another in response to a flow rate through a fluid flow path extending through the segmented tubular section reaching a predetermined threshold.

10. The wellbore system of claim 9, wherein the BHA includes a downhole tool fluidly coupled to the fluid flow path to discharge fluid from BHA into the wellbore.

11. The wellbore system of claim 10, wherein the pair of actuators comprises a fluid pump in fluid communication with a fluid source and operable to adjust the flow rate of fluid through the fluid flow path.

12. The wellbore system of claim 8, wherein the rotational driver comprises a motor disposed within at least one of the upper or lower housings.

13. The wellbore system of claim 8, further comprising a sensor package coupled between the conveyance and the upper housing.

14. The wellbore system of claim 13, wherein the sensor package includes at least one of the group consisting of a casing collar locator operable to determine a depth of the multilateral entry tool within the main wellbore, a toolface sensor operable to determine a rotational orientation of the BHA and an inclination sensor operable to determine an inclination of the sensor package.

15. A method of deploying a bottom hole assembly (BHA) into a lateral wellbore branching from a main wellbore, the method comprising;

conveying the BHA into the main wellbore on a wellbore conveyance to a depth above the lateral wellbore;

rotationally orienting the BHA with an orientation sub coupled to the conveyance and defining a tool axis by employing an orientation actuator independently of a kick-over actuator to rotate the BHA about the tool axis without pivoting the BHA with respect to the tool axis;

articulating the BHA with a kick-over sub coupled to the orientation sub by employing a kick-over actuator independently of the orientation actuator to pivot the BHA without rotating the BHA; and further conveying, after orienting and articulating the BHA, to pass the BHA through a casing window into the lateral wellbore.

16. The method of claim 15, further comprising returning the BHA to an aligned configuration with respect to the orientation sub within the lateral wellbore and further advancing the BHA into the lateral wellbore.

17. The method of claim 15, further comprising counting casing collars in a casing string in the main wellbore to determine a depth of the BHA relative to the lateral wellbore.

18. The method of claim 15, further comprising verifying an entry into the lateral wellbore by measuring an expected inclination of the lateral wellbore with an inclination sensor coupled between the orientation sub and the conveyance.

* * * * *